US010247038B2

(12) United States Patent
Kappes et al.

(10) Patent No.: US 10,247,038 B2
(45) Date of Patent: Apr. 2, 2019

(54) FLANGE FASTENING ASSEMBLY IN A GAS TURBINE ENGINE

(71) Applicant: Rolls-Royce Corporation, Indianapolis, IN (US)

(72) Inventors: Matthew J. Kappes, Greenwood, IN (US); Erin M. Romanowski, Avon, IN (US); Dennes K. Burney, Indiananpolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 363 days.

(21) Appl. No.: 15/299,022

(22) Filed: Oct. 20, 2016

(65) Prior Publication Data

US 2018/0112557 A1 Apr. 26, 2018

(51) Int. Cl.

| | |
|---|---|
| ***F01D 25/24*** | (2006.01) |
| ***F01D 25/00*** | (2006.01) |
| ***F01D 21/04*** | (2006.01) |

(52) U.S. Cl.

CPC ..... *F01D 25/243* (2013.01); *F01D 21/045* (2013.01); *F01D 25/005* (2013.01); *F05D 2220/32* (2013.01); *F05D 2260/31* (2013.01)

(58) Field of Classification Search

CPC .... F01D 21/045; F01D 25/005; F01D 25/243; F04D 2220/32; F04D 2260/31

See application file for complete search history.

(56) References Cited

U.S. PATENT DOCUMENTS

| | | | | |
|---|---|---|---|---|
| 6,176,663 | B1 * | 1/2001 | Nguyen | F16L 23/003 285/412 |
| 6,200,223 | B1 * | 3/2001 | Martens | F16D 3/78 464/99 |
| 6,374,665 | B1 * | 4/2002 | Somppi | B62D 17/00 73/146 |
| 6,641,326 | B2 * | 11/2003 | Schilling | F16B 5/0275 403/337 |
| 7,056,053 | B2 * | 6/2006 | Schilling | F16B 43/02 403/337 |
| 2002/0141859 | A1 * | 10/2002 | Sathianathan | F01D 21/045 415/9 |
| 2004/0101384 | A1 | 5/2004 | Schilling et al. | |
| 2013/0149139 | A1 * | 6/2013 | Wallace | F01D 21/04 415/214.1 |

FOREIGN PATENT DOCUMENTS

| | | |
|---|---|---|
| EP | 1 245 794 | 10/2002 |
| EP | 2 554 479 | 2/2013 |
| EP | 2 602 434 | 6/2013 |

OTHER PUBLICATIONS

Extended European Search Report for European Application No. EP 17 19 1237.1-1006, completed on Mar. 3, 2018, for Applicant, Rolls-Royce Corporation (9 pages).

* cited by examiner

*Primary Examiner* — Igor Kershteyn
(74) *Attorney, Agent, or Firm* — McCracken & Gillen LLC

(57) ABSTRACT

According to one aspect, a flange fastening assembly for a gas turbine engine includes a first flange having a first hole therein, a second flange having a second hole disposed adjacent to the first flange, and a shoulder bolt disposed through the first hole and the second hole. The shoulder bolt has a head portion, a stem portion, and a thread portion, and the stem portion and the thread portion define a shoulder. A bolt nut is disposed on the thread portion and a first spacer is disposed between the bolt nut and the first flange such that the first spacer overhangs the shoulder.

18 Claims, 5 Drawing Sheets

FLANGE FASTENING ASSEMBLY IN A GAS TURBINE ENGINE

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

FIELD OF DISCLOSURE

The present subject matter relates to flange fastening assemblies, and more particularly, to flange fastening assemblies in gas turbine engines.

BACKGROUND

Gas turbine engines comprise a number of components that are assembled in series and axially. Some of the components are mechanically engaged and fastened together utilizing various types of fasteners and alignment components. For example, in fastening a fan case to a mounting case in a gas turbine engine a number of bolts and pins may be used to both align and maintain an attachment of the two cases. More specifically, a set of pins disposed in pin holes in the fan case and the mounting case maintain alignment and reduce or eliminate radial and circumferential movement. A set of bolts are used to keep the fan case and the mounting case fastened together to prevent separation of the fan case and the mounting case in an axial direction.

Referring to FIG. 1, an existing flange fastening assembly in a gas turbine engine that connects a fan case to a mounting case is shown. A portion of a fan case 10 and a mounting case 12 are shown that are fastened and aligned together using fasteners 14 and a pin 16. The fasteners 14 are disposed through a fan case flange 18 and a mounting case flange 20. The pin 16 is disposed in a pin hole 22 and resists shear forces imparted on the fan case 10 and the mounting case 12 in radial and circumferential directions. It should be noted that the pin 16 and the pin hole 22 are in some circumstances referred to as a shear pin and a shear pin hole respectively. It is highly desirable to make sure that the fan case 10 remains attached to the mounting case 12 during and after a fan blade out (FBO) event in a gas turbine engine (not shown). In an FBO event, a fan blade may completely or partially break off from a fan rotor (not shown). This may likely cause an imbalance in the operation of the fan rotor and generate undesired large forces that could separate the fan case 10 from the mounting case 12 in the axial and/or radial and/or circumferential directions by breaking the fasteners 14 and/or pin(s) 16. Thus, there is a need to retrofit the flange fastening assembly so that during and after an FBO event the fan case is not separated from the mounting case to an extent that would cause a failure in the gas turbine engine.

SUMMARY

According to one aspect, a flange fastening assembly for a gas turbine engine includes a first flange having a first hole therein and a second flange having a second hole disposed adjacent to the first flange. A shoulder bolt is disposed through the first hole and the second hole and the shoulder bolt has a head portion, a stem portion, and a thread portion, wherein the stem portion and the thread portion define a shoulder. A bolt nut is disposed on the thread portion and a first spacer is disposed between the bolt nut and the first flange such that the first spacer overhangs the shoulder.

According to another aspect, a method of retrofitting a flange fastening assembly in a gas turbine engine having a first and a second flange each having an aperture defining a shear pin hole configured to receive a shear pin therethrough is disclosed. The method further includes disposing a shoulder bolt through the shear pin hole, wherein the shoulder bolt has a head portion, a stem portion, and a thread portion, and wherein the stem portion and the thread portion define a shoulder; providing a bolt nut on the thread portion; and disposing a first spacer between the bolt nut and the first flange such that the first spacer overhangs the shoulder.

Other aspects and advantages will become apparent upon consideration of the following detailed description and the attached drawings wherein like numerals designate like structures throughout the specification.

DETAILED DESCRIPTION

As shown herein a flange fastening assembly is provided that may be implemented either in an original or in a retrofit embodiment for a gas turbine engine. The flange fastening assembly may be utilized in a preexisting arrangement of a fan case and a mounting case as a retrofit to provide additional fastening capability. More specifically, in current flange fastening assemblies, the pin may be removed from the pin hole and a present embodiment of a flange fastening assembly including a shoulder bolt with a pair of spacers and a bolt nut may replace the pin. In this manner, the flange fastening assembly provides both the functionality of the shear pin (as described above) as well as additional fastening functionality by maintaining the fan case connected to the mounting case.

Figure 1:
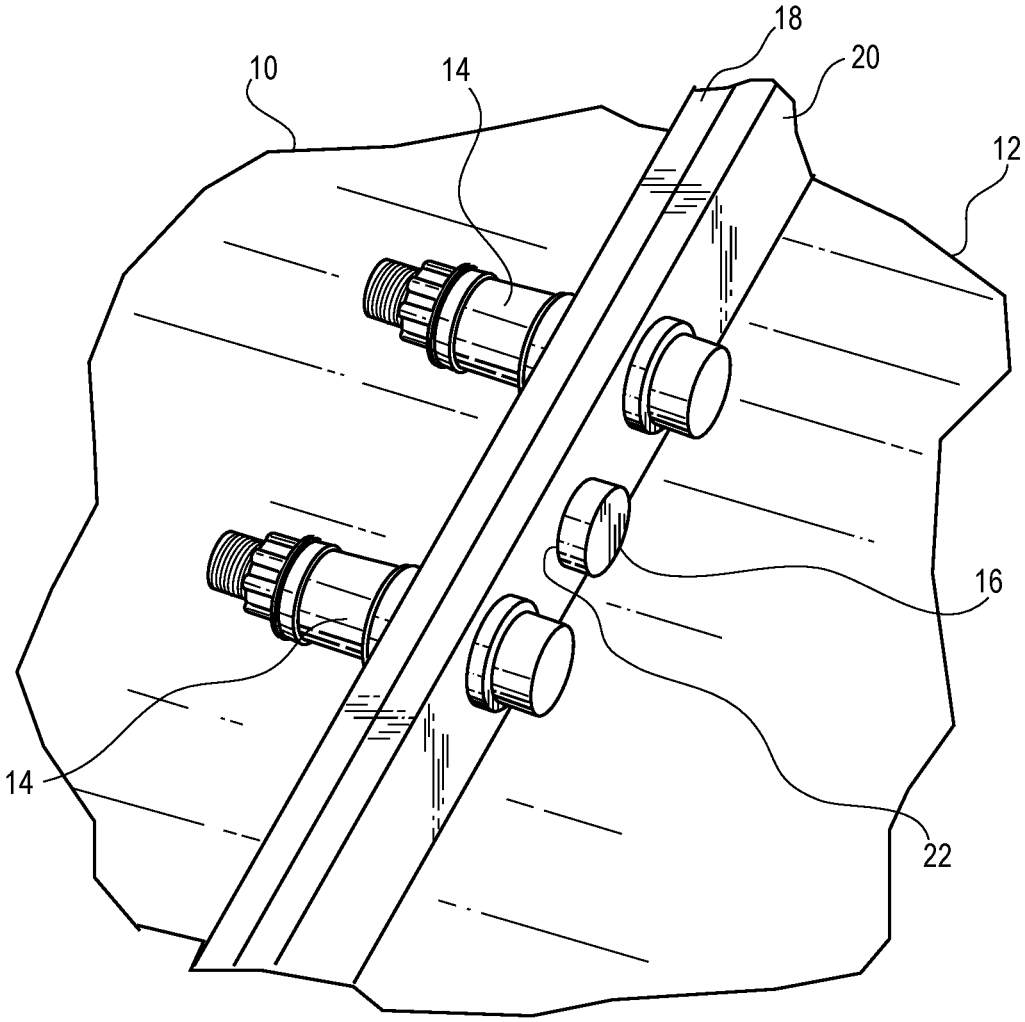
FIG. 1 PRIOR ART
FIG. 1 is an enlarged, fragmentary, perspective view of an existing flange fastening assembly for a gas turbine engine.
Figure 2:
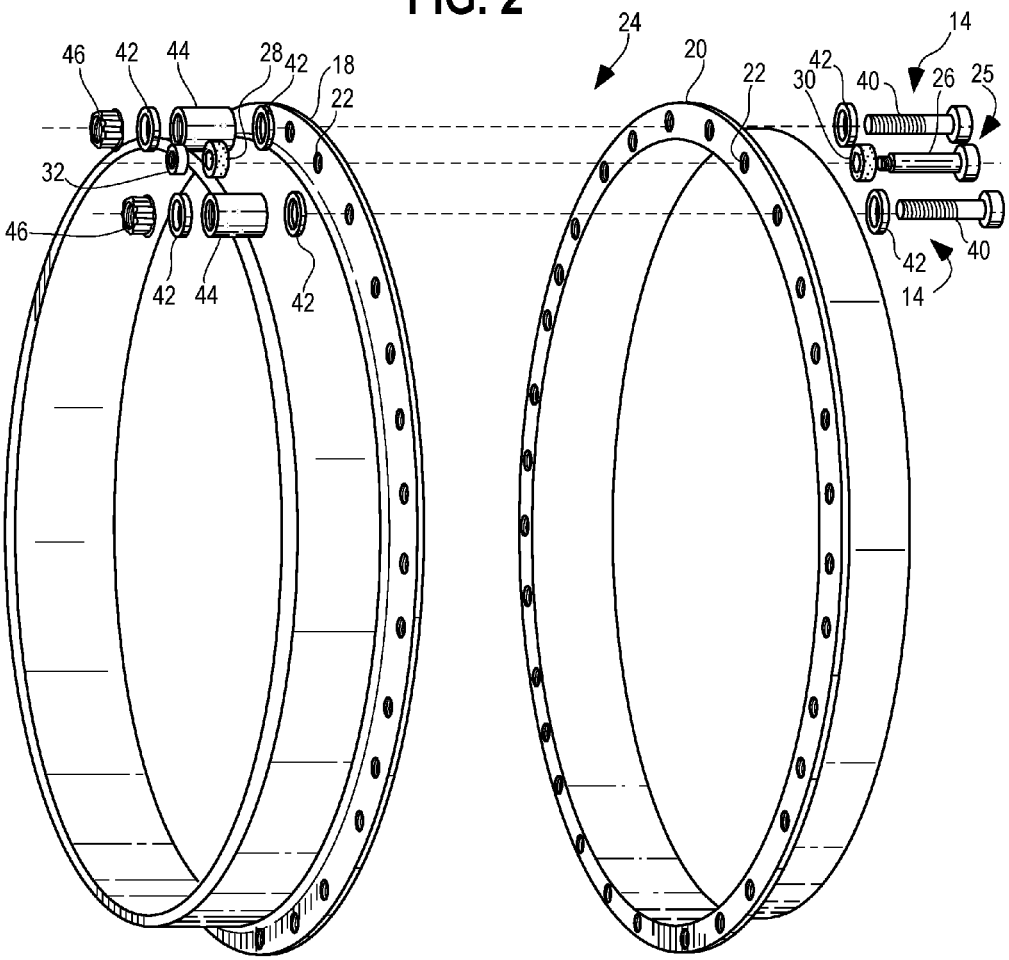
FIG. 2 is an exploded, perspective view of an embodiment of a flange fastening assembly for a gas turbine engine.

Referring to FIG. 2, an exploded view of an embodiment of the flange fastening assembly 24 is shown having a shoulder bolt assembly 25 including a shoulder bolt 26, a first spacer 28, a second spacer 30, and a bolt nut 32 for fastening a fan case flange 18 to a mounting case flange 20. Furthermore, a pair of conventional fasteners 14 are shown that may be used for fastening the fan case flange 18 to the mounting case flange 20. The fasteners 14 include bolts 40, washers 42, sleeves 44, and end nuts 46. The shoulder bolt 26 is inserted and disposed in the pin hole 22 and replaces a preexisting pin 16 (shown in FIG. 1). Therefore, this replacement of the pin 16 with the shoulder bolt 26 avoids the need to drill new holes in the fan case flange 18 and the mounting case flange 20 or some other physical modification of a preexisting design in the gas turbine engine.

Figure 3:
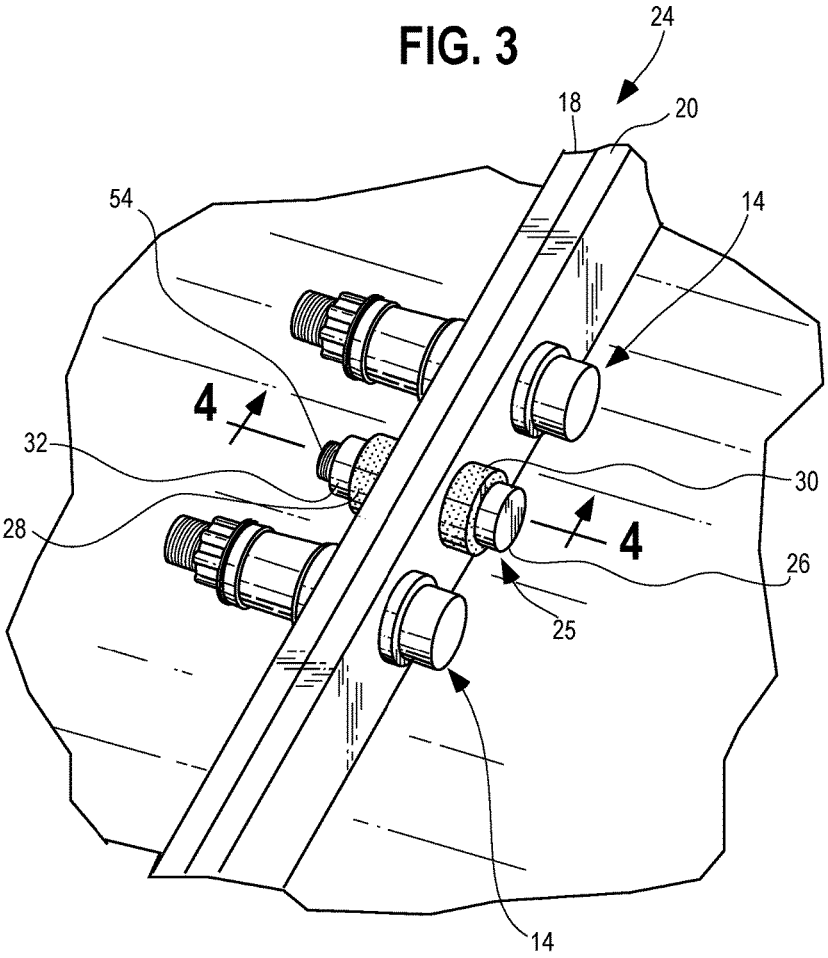
FIG. 3 is an enlarged, fragmentary, perspective view of the embodiment of the flange fastening assembly for a gas turbine engine of FIG. 2.

Referring to FIG. 3, an enlarged, fragmentary view of the flange fastening assembly 24 is shown. As seen, the flange fastening assembly 24 connects and brings together the fan case flange 18 and the mounting case flange 20. During or after an FBO event, there is a possibility that the fasteners 14 may break and as a result the fan case flange 18 may separate from the mounting case flange 20. This separation can be detrimental to the operation of the gas turbine engine. The shoulder bolt assembly 25 is configured such that the shoulder bolt 26 remains structurally substantially unaffected during the FBO event and is available to provide fastening capability to keep the fan case 18 substantially connected to the mounting case 20 after the FBO event. The shoulder bolt assembly 25 can maintain a connection of the fan case flange 18 with the mounting case flange 20 for a required extended period of time until for example a gas turbine engine driven plane can land safely. It should be noted that more than one shoulder bolt assembly 25 may be strategically utilized at various locations around circumferences of the fan case flange 18 and the mounting case flange 20 within the pin holes 22 in place of the pins 16 (see FIG. 1).

Figure 4:
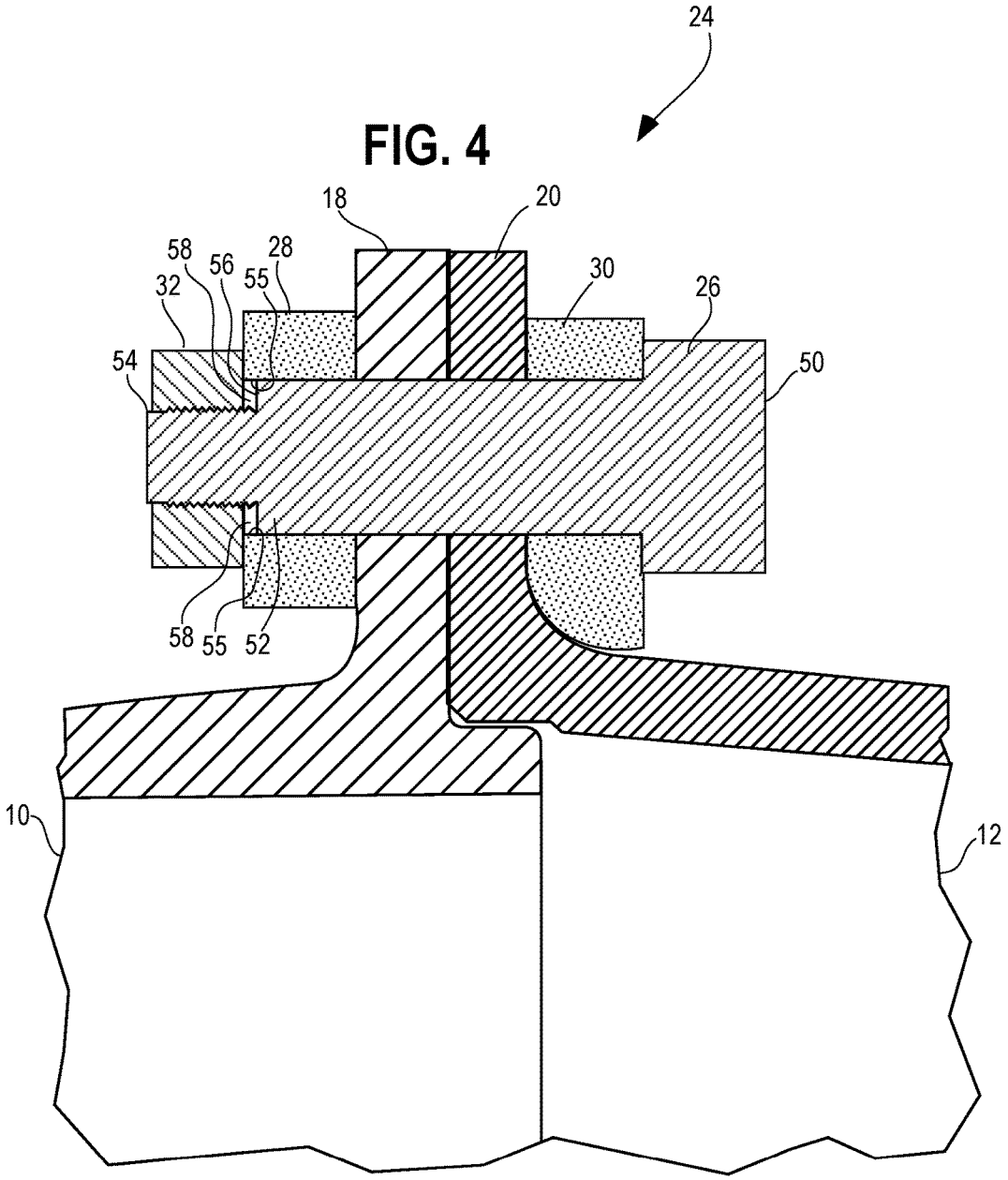
FIG. 4 is a cross-sectional, side view of the embodiment of the flange fastening assembly for a gas turbine engine of FIG. 3 along line 4-4 in a pre-operation state.

FIG. 4 illustrates a cross-sectional side view of the flange fastening assembly 24 in a pre-operation state. The arrangement of the flange fastening assembly 24 provides for a reduction or elimination of axial preload (as described below) through the fan case flange 18 and the mounting case flange 20. As seen, shoulder bolt 26 has a head portion 50, a stem portion 52, and a thread portion 54. A shoulder 56 is defined by the stem portion 52 and the thread portion 54. In a pre-operation state, a gap 58 exists between the bolt nut 32 disposed on the thread portion 54 and the shoulder 56. The first spacer 28 is disposed between the bolt nut 32 and the fan case flange 18 such that the first spacer 28 overhangs 55 the shoulder 56 and over the gap 58. A determination of a depth of the gap 58 is predicated on compressibility of a material of the first spacer 28 and the second spacer 30 as further described below.

Figure 5:
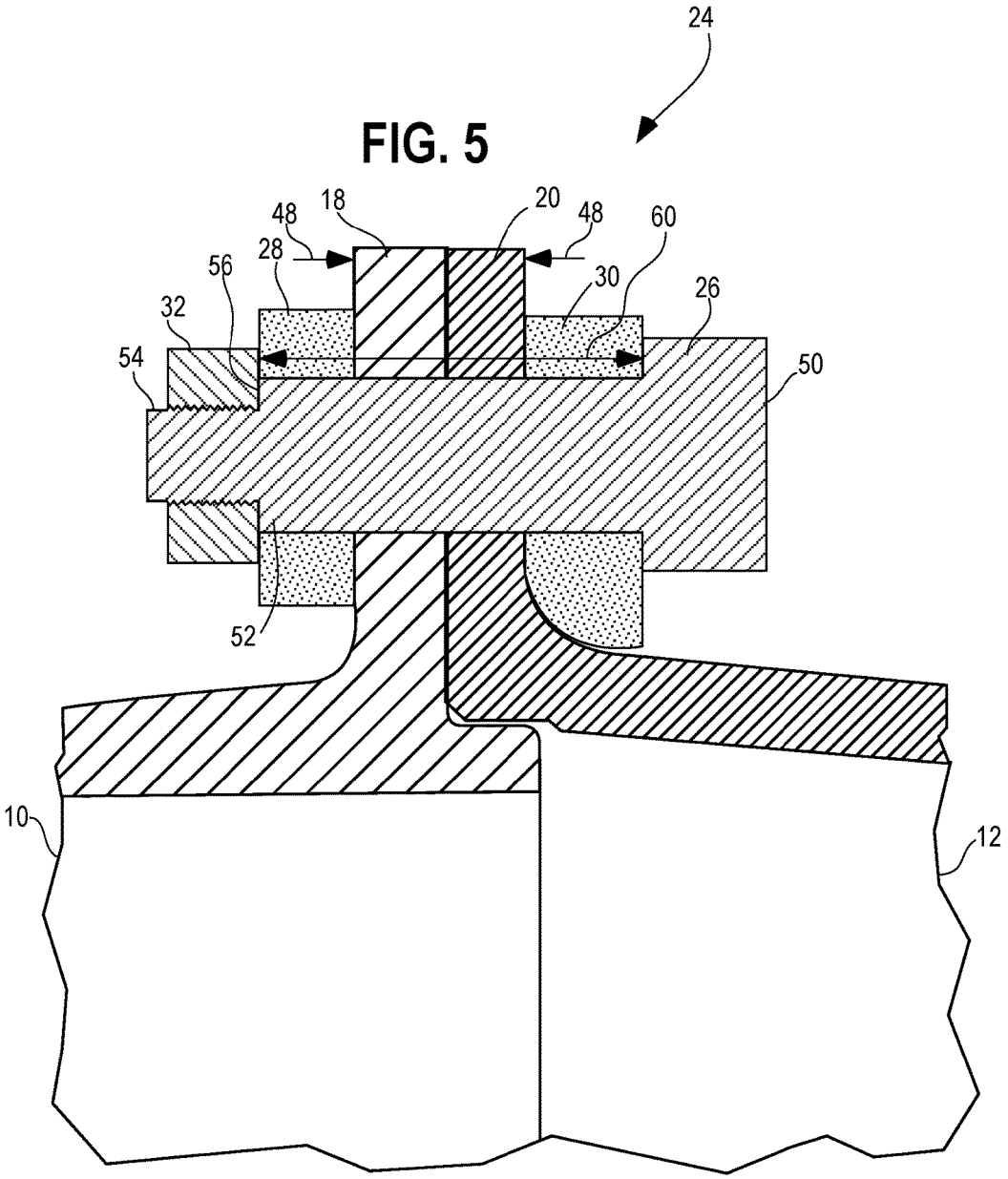
FIG. 5 is a cross-sectional, side view of the embodiment of the flange fastening assembly for a gas turbine engine of FIG. 4 in an operational state.

Referring to FIG. 5, the flange fastener assembly 24 is shown in an operational state. As the bolt nut 32 is torqued or twisted toward the joints 18 and 20, the axial preload (as shown by facing arrows 48) in a form of a compressive force is imparted onto the flanges 18 and 20 through the first spacer 28 and the second spacer 30. The amount of the compressive force is limited to a preload compression level because of the shoulder 56. A travel distance of the bolt nut 32 is delimited by the shoulder 56 that limits the amount of preload compression level. Stated another way, the amount of the preload compression level is based on an extent of compression of the overhang 55 of the first spacer 28. Also, since for every action there is an equal and opposite reaction, then in reaction to the axial preload 48 there is an equal and opposite force in a form of a tensile load 60 (shown as a two-headed arrow) that is imparted onto the shoulder bolt 26. In the operational state of the flange fastener assembly 24, it is desired to limit the axial preload and the tensile load to a negligible amount so that the shoulder bolt 26 is not under stress and, therefore, not fatigued so that it is available for use after an FBO event has occurred. In order to limit the axial preload 48 and the corresponding tensile load 60 on the shoulder bolt 26, the bolt nut 32 is delimited in its travel distance toward the head portion 26 by the shoulder 56. Furthermore, the first spacer 28 is sized appropriately to fill a space between the fan case flange 18 and the bolt nut 32. The sizes of the first spacer 18 and the second spacer 20 are dependent on the compressibility characteristics of each of the first spacer 28 and the second spacer 30, which are dictated by materials of the two spacers 28 and 30. The first spacer 28 and the second spacer 30 may be made of any one of a nylon, hard plastic, elastomer, metallic material or any other suitable material known to a person skilled in the art. By way of example, if the first spacer 28 and the second spacer 30 are made of a metallic material, then they would be less compressible compared to a nylon material, which would be more compressible. It should be noted that either or both of the spacers 28 and 30 may have various geometries or shapes, such as, for example, a coil spring type, a washer type, or any other shapes that provide appropriate compressibility in conjunction with the material of the corresponding spacer.

Referring again to FIG. 4, the amount of overhang 55, which corresponds to the depth of the gap 58, should be a predetermined amount dictated by the compressibility characteristic of a selected suitable material for the first spacer 28 and the second spacer 30. It should be noted that in alternative embodiments, the flange fastener assembly 24 may include only one or the other of the first spacer 28 and the second spacer 30 and operationally provide the same or a similar result. In an embodiment where both the first spacer 28 and the second spacer 30 are employed, the amount of overhang 55 is based on the combination of sizes/thicknesses of the first pacer 28 and the second spacer 30, which are in turn determined based on each spacer's compressibility characteristic. A total thickness of the combination of the first spacer 28 and the second spacer 30 result in the amount of overhang 55. Furthermore, a length of the shoulder bolt 26 is determined based on a predetermined amount of force during an FBO event in the gas turbine engine. In other words, in a design of the gas turbine engine and through engineering simulations, a maximum amount of force generated during the FBO event is calculated and this maximum amount of force is used to select the material and determine the thicknesses of the first spacer 28 and the second spacer 30 so that the spacers 28 and 30 can compress and absorb the FBO force. The combination of the first spacer 28 and the second spacer 30 absorb the FBO force and minimize an amount of tensile load 60 on the shoulder bolt 26. Accordingly, the length of the shoulder bolt 26 is calculated to allow for the thicknesses of the first and second spacers 28 and 30 as well as thicknesses of the fan case flange 18 and the mounting case flange 20. It should be noted that the design options for the flange fastening assembly as described herein are not limited to any specific application or industry.

INDUSTRIAL APPLICABILITY

As provided herein, the flange fastening assembly may be employed in connection with automotive systems, and more specifically is intended to be used in a gas turbine engine of an aircraft. The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only, and should not be taken as limiting the scope of the disclosure.

We claim:

1. A flange fastening assembly for a gas turbine engine comprising:

a first flange having a first hole therein;

a second flange having a second hole disposed adjacent to the first flange;

a shoulder bolt disposed through the first hole and the second hole, the shoulder bolt comprising a head portion, a stem portion, and a thread portion, wherein the stem portion and the thread portion define a shoulder;

a bolt nut disposed on the thread portion; and a first spacer disposed between the bolt nut and the first flange such that the first spacer overhangs the shoulder.

2. The flange fastening assembly of claim 1, wherein a travel distance of the bolt nut toward the head portion is delimited by the shoulder.

3. The flange fastening assembly of claim 2, wherein the first spacer is sized to fill a space between the first flange and the bolt nut.

4. The flange fastening assembly of claim 3, wherein the bolt nut in a fully torqued arrangement compresses the first spacer to an extent limited by a location of the shoulder such that a predetermined preload compression is imparted on the first spacer.

5. The flange fastening assembly of claim 4, further comprising a second spacer disposed between the head portion and the second flange such that the second spacer in combination with the first spacer receive the preload compression.

6. The flange fastening assembly of claim 5, wherein the second spacer is sized such that in combination with the first spacer comprise a total thickness that determines an amount of the overhang.

7. The flange fastening assembly of claim 6, wherein a length of the shoulder bolt is determined based on a predetermined amount of force during a fan blade out (FBO) event in the gas turbine engine such that the combination of the first spacer and the second spacer absorb the FBO force and minimize an amount of tensile load on the shoulder bolt.

8. The flange fastening assembly of claim 5, wherein the first spacer and the second spacer are made of any one of a nylon, hard plastic, elastomer, metallic, and resilient material.

9. The flange fastening assembly of claim 1, wherein the first hole and the second hole are a first shear pin hole and a second shear pin hole respectively.

10. A method of retrofitting a flange fastening assembly in a gas turbine engine having a first and a second flange each having an aperture defining a shear pin hole configured to receive a shear pin therethrough, the method comprising:

disposing a shoulder bolt through the shear pin hole, wherein the shoulder bolt comprises a head portion, a stem portion, and a thread portion, wherein the stem portion and the thread portion define a shoulder;

providing a bolt nut on the thread portion; and disposing a first spacer between the bolt nut and the first flange such that the first spacer overhangs the shoulder.

11. The method of claim 10, further comprising:

torquing the bolt nut toward the head portion; and bringing into contact the bolt nut and the first spacer.

12. The method of claim 11, further comprising:

compressing the first spacer by the bolt nut to a preload compression level.

13. The method of claim 12, further comprising:

delimiting a travel distance of the bolt nut toward the head portion by the shoulder.

14. The method of claim 13, wherein an amount of the preload compression level is based on an extent of compression of the overhang of the first spacer.

15. The method of claim 14, further comprising:

disposing a second spacer between the head portion and the second flange.

16. The method of claim 15, further comprising:

determining an amount of overhang based on a total thickness of a combination of thicknesses of the first spacer and the second spacer.

17. The method of claim 16, further comprising:

determining a length of the shoulder bolt based on an amount of force during a fan blade out (FBO) event in the gas turbine engine such that a combination of the first spacer and the second spacer absorb the FBO force and minimize an amount of tensile load on the shoulder bolt.

18. The method of claim 15, wherein the first spacer and the second spacer are made of any one of a nylon, hard plastic, elastomer, metallic, and resilient material.

* * * * *